United States Patent [19]

Gleason et al.

[11] Patent Number: 4,791,007

[45] Date of Patent: Dec. 13, 1988

[54] PAINT SHIELD METHOD

[76] Inventors: Joseph D. Gleason, 2912 East McKellips, #90, Mesa, Ariz. 85203; Mark L. Miller, 14806 East Second Avenue, #311, Aurora, Colo. 80011

[21] Appl. No.: 923,888

[22] Filed: Oct. 28, 1986

[51] Int. Cl.[4] ..... B05D 1/32

[52] U.S. Cl. ..... 427/282; 427/284; 118/504; 118/505

[58] Field of Search ..... 427/282, 284; 118/504, 118/505

[56] References Cited

U.S. PATENT DOCUMENTS 1,411,462 4/1922 Wendt ..... 118/504

4,357,898 11/1982 Fehrenbacher ..... 118/504

FOREIGN PATENT DOCUMENTS 2161726 1/1986 United Kingdom ..... 118/504

*Primary Examiner*—Thurman K. Page

*Assistant Examiner*—L. R. Horne

*Attorney, Agent, or Firm*—Harry M. Weiss

[57] ABSTRACT

A paint shield for masking a door or window frame, or painting an adjacent wall and a method for its use are disclosed. The paint shield includes a substantially planar, rectangular portion of sheet like material. A substantially planar blade portion extends at right angles to the rectangular portion and has a width greater than or equal to the thickness of the frame to be masked. The blade portion terminates in a straight edge. A handle is affixed to the rectangular portion and is used to position the rectangular over the frame with the straight edge of the blade portion positioned against the wall at the intersection between the wall and the frame.

1 Claim, 1 Drawing Sheet

PAINT SHIELD METHOD

BACKGROUND OF THE INVENTION

This invention relates generally to a paint shield and method, and more specifically to a paint shield for masking around a door or window frame and to a method for its use.

There are a large number of different paint shields available for masking a glass window pane while painting the mullions between panes, for protection the carpet while painting baseboards, and the like. There are even paint shields for protecting a wall while painting a door frame, but there is not a satisfactory paint shield for use to protect a door frame or window frame while painting the adjacent wall.

SUMMARY OF THE INVENTION

Accordingly, it is an object of this invention to provide an improved paint shield for masking a door or window frame while painting an adjacent wall.

It is a further object of this invention to provide an improved method for painting a wall and simultaneously masking an adjacent door or window frame.

It is a still further object of this invention to provide an improved, simple, easy to use, paint shield.

The foregoing and other objects and advantages of the invention are achieved with a paint shield which covers a portion of door or window frame including both the face and side of the frame while an adjacent wall is being painted. In one embodiment of the invention, the paint shield includes a substantially planar, rectangular portion of sheet like material and a substantially planar, blade portion which extends at right angles to the rectanular portion and which has a width greater than or equal to the thickness of the frame which is to be masked. The blade portion terminates in a straight edge. A handle affixed to the rectangular portion provides for positioning the paint shield over the frame with the rectangular portion covering the base of the frame and the blade portion covering the edge of the frame. The shield is positioned with the straight edge positioned against the wall at the intersection between the wall and the frame.

DETAILED DESCRIPTION OF THE PREFERRED EMBODIMENTS

Figure 1:
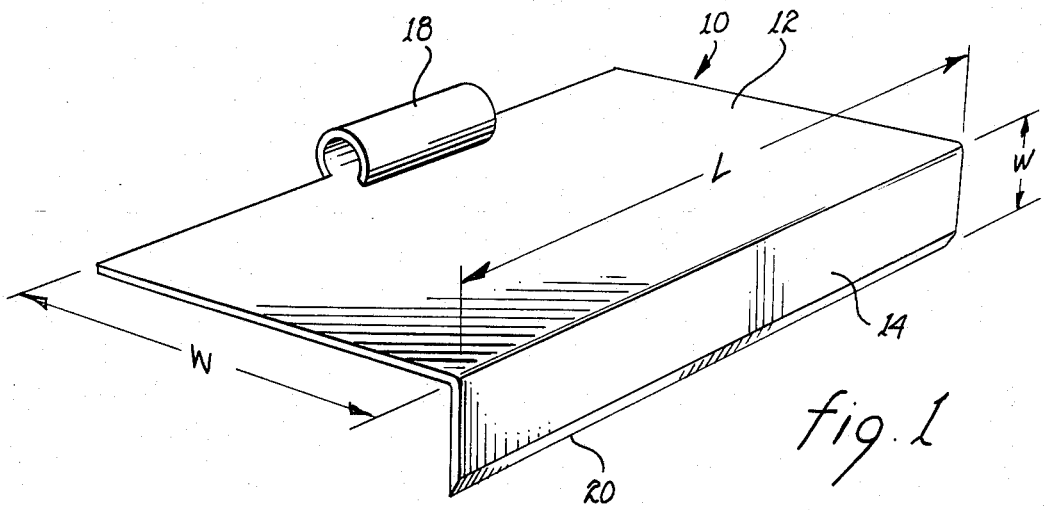
FIG. 1 illustrates, in perspective view, a paint shield in accordance with one embodiment of the invention.
Figure 2:
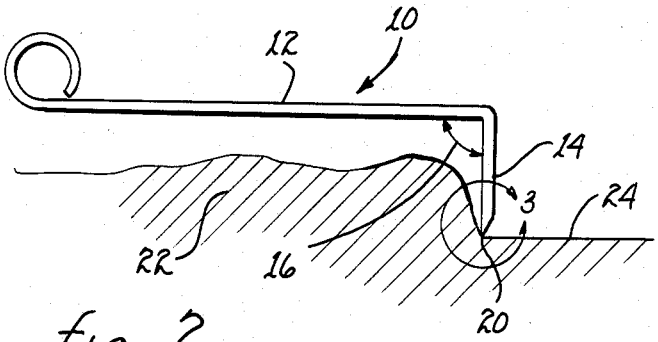
FIG. 2 illustrates the paint shield in end view.

A paint shield 10 is illustrated in perspective view and side view, respectively, in FIGS. 1 and 2. The paint shield includes a generally rectangular, substantially planar portion 12 and a blade portion 14 which are joined at a right angle as illustrated by the double headed arrow 16. The paint shield further includes a handle 18 affixed to the rectangular member 12. Portion 12 can have other arbitrary shapes, but preferably is substantially rectangular in shape. The rectangular portion has a Length and a Width. The blade portion has a width with the dimensions indicated in FIG. 1. The blade portion 14 terminates in a straight edge 20.

As illustrated in FIG. 2, in use, the paint shield is positioned overlying a door or window frame 22 which can have any arbitrary shape. The rectangular portion 12 generally protects and masks the face of frame 22 while blade member 14 protects the edge of the frame. The paint shield is positioned so that straight edge 20 is positioned against the wall 24 which is to be painted, and specifically at the intersection between the wall and the frame.

The paint shield is formed of any rigid material such as plastic, sheet metal, or the like. Preferably the shield is made from a lightweight, extruded material such as aluminum. In a preferred embodiment, the rectangular portion 12 has a length greater than about 30 inches and a width greater than about 4 inches. Blade portion 14 must have a width greater than or equal to the thickness of the frame to be protected, and preferably have the width of about one inch.

Figure 3:
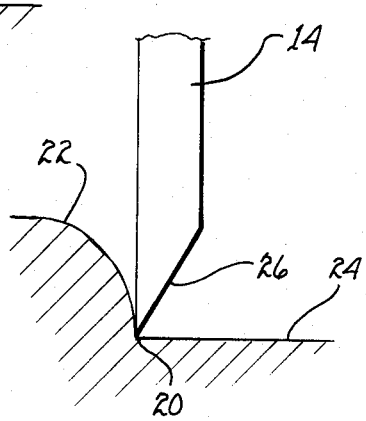
FIG. 3 illustrates the blade portion, in accordance with one embodiment of the invention, in further detail.

A preferred embodiment of the invention is shown in greater detail in FIG. 3. As illustrated, blade 14 is tapered to a knife edge 26 along the straight edge 20. The knife edge allows wall 24 to be painted up to the edge of frame 22 without getting any paint on the frame. Alternatively, the paint shield can be formed of a thin, rigid material so that the blade portion is thin and the wall can be painted nearly to the frame.

Figure 4:
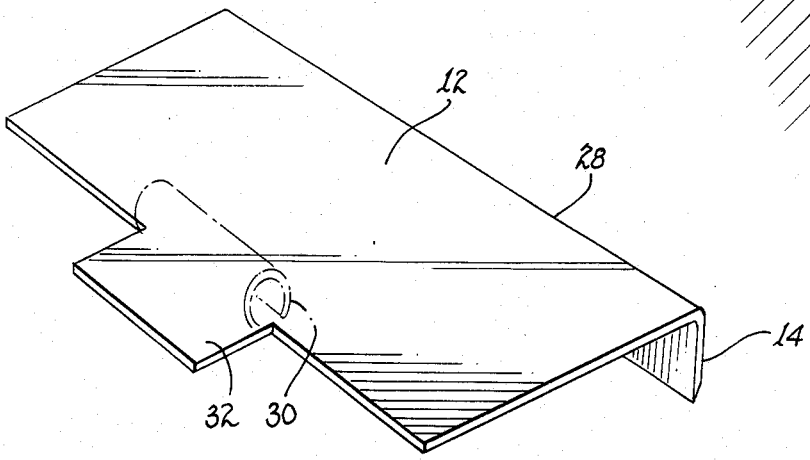
FIG. 4 illustrates, in perspective view, the further embodiment of the invention.

FIG. 4 illustrates, in perspective view, a paint shield in accordance with a further embodiment of the invention. This embodiment of the paint shield also includes a substantially rectangular, substantially planar shield member 12 joined to a blade member 14. In this embodiment, the paint shield if formed from a single piece of sheet metal which is folded along edge 28 to position the blade member 14 at an angle of 90 degrees with respect to the rectangular shield member 12. In this embodiment of the invention, handle 30 which is here shown in ghost, is formed from a rolled extension 32 of the shield member 12. That is, the entire paint shield is made from a single piece of sheet metal or plastic which includes a blade portion 14, shield portion 12 and handle extension 32. The handle extension is rolled to form handle 30 and the remainder of the single piece of sheet metal is bent to form the blade and shield members. The handle 30, thus illustrated, differs from handle 18 which can be, for example, a piece of slotted tubular plastic, wood, metal, or the like which is attached to the rectangular portion 12 as illustrated in FIGS. 1 and 2.

The paint shield is used, in accordance with the invention, by holding the handle in one hand and positioning the paint shield over the face and side of the frame to be masked. The wall is then painted, by either spraying or brushing using the other hand to direct the painting implement. The paint shield is lightweight and can easily be handled, positioned, and moved with one hand. The paint shield is long enough, however, to mask a sufficient portion of the frame to allow the rapid and accurate painting of the adjacent wall. The length of the paint shield easily allows the wall to be spray painted without inadvertantly painting the frame. As one section of the wall is completed, the paint shield is moved to mask another portion of the frame adjacent an unpainted wall section.

Thus it is apparent that there has been provided, in accordance with the invention, a paint shield and method for its use which fully meets the objects and advantages set forth above. Although the paint shield and method have been described and illustrated with reference to specific embodiments thereof, it is not intended that the invention be limited to these illustrative embodiments. Those skilled in the art will recognize, after review of the foregoing detailed description, that variations and modifications are possible without departing from the spirit of the invention. It is therefore intended that the invention include all such variations and modifications as fall within the scope of the appended claims.

What is claimed is:

1. A method for protecting a door or window frame from paint by using a paint shield comprising:

placing a door or window frame covering means comprising a substantially planar rectangular front surface masking portion of sheet like material having a length greater than about 30 inches and a width greater than about 4 inches for covering a front surface portion of a door or window frame;

providing a substantially planar rectangular blade portion extending at a right angle to said rectangular front surface masking portion, said right angle rectangular blade portion having a width greater than the exposed thickness of said door or window frame, said right angle rectangular blade portion having a tapered free end portion that extends along a portion of the intersection of the wall to be painted and said door or window frame; and providing handle means coupled to said rectangular front surface masking portion for positioning said door or window frame covering means with respect to portions of said door or window frame.

* * * * *